United States Patent [19]

Wright

[11] Patent Number: 4,619,179

[45] Date of Patent: Oct. 28, 1986

[54] (MUSICAL) DRUMS

[75] Inventor: Robert J. Wright, Reservoir, Australia

[73] Assignee: Legato Pty. Ltd., Reservoir, Australia

[21] Appl. No.: 675,085

[22] Filed: Nov. 26, 1984

[30] Foreign Application Priority Data

Dec. 1, 1983 [AU] Australia ..... PG2659

[51] Int. Cl.[4] ..... G10D 13/02

[52] U.S. Cl. ..... 84/413

[58] Field of Search ..... 84/411–420

[56] References Cited

U.S. PATENT DOCUMENTS 804,347 11/1905 Schultz ..... 84/413

3,981,220 9/1976 Clark ..... 84/415

4,060,018 11/1977 Gilbrech ..... 84/269

4,520,709 6/1985 Kester ..... 84/415

*Primary Examiner*—Lawrence R. Franklin

*Attorney, Agent, or Firm*—Trexler, Bushnell & Wolters, Ltd.

[57] ABSTRACT

A drum tensioning system adapted to place a minimum of stress on the drum shell has a plurality of C-shaped clips acting on the counterhoop to apply tension to the drum head. The head passes over a cylindrical side wall which has flanges extending radially outwardly. The tensioning bolts pass through apertures in the flanges directly beneath the C-clips and are threaded into the base of the C-clips. The C-clips and counterhoop have mating surfaces which provide stability to the system. The side wall is attached to the drum shell.

2 Claims, 2 Drawing Figures

FIG. 1
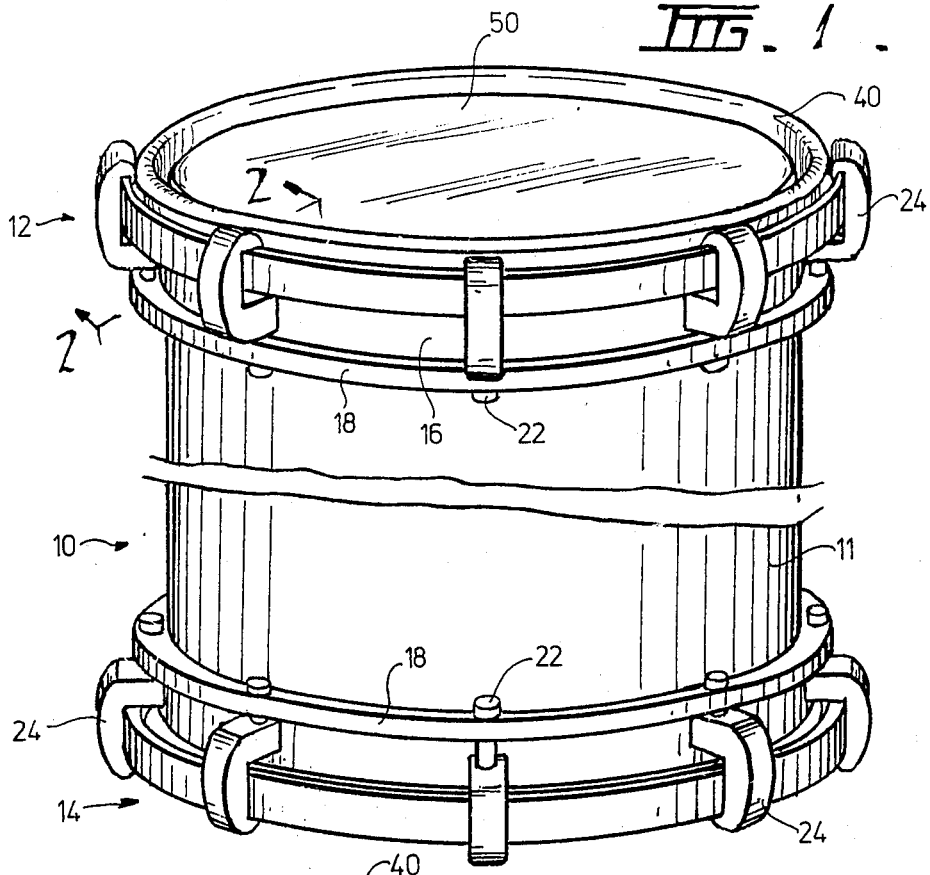
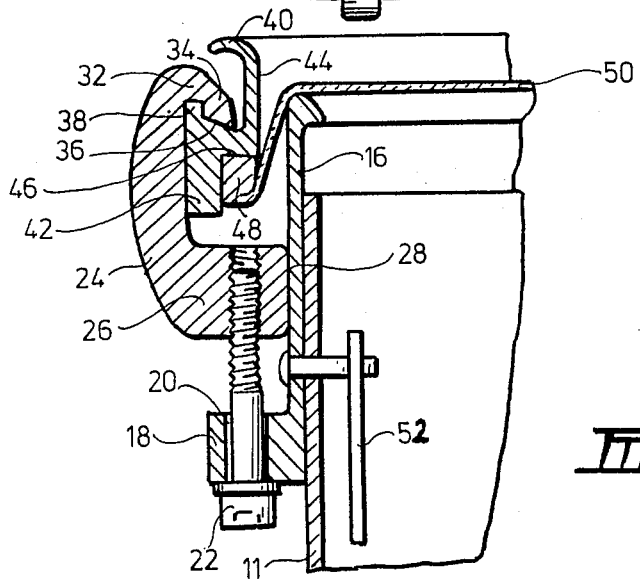
FIG. 2

(MUSICAL) DRUMS

This invention relates to (musical) drums of the kind including side-drums of a generally cylindrical form the ends whereof constitute drum-heads across which are stretched skins or membranes (which may be of e.g. plastics, parchment or natural or synthetic fabric) adjustably connected to a shell structure such as through screw or other peripherally-spaced devices capable of exerting or permitting a controllable radial tension or relaxation in said skin.

The invention is also applicable to the tambour, tambourine and other such percussion instruments incorporating a membrane or membranes stretched across one or both ends of a drum-shaped shell or body.

Parchment was largely superseded by plastics, typically "Mylar" (Registered Trade Mark), as a skin material. However some plastics tend to stretch under tension, leading to instability in the "pitch" and other characteristics of the drum. In view of such difficulties, certain aramid fibrous materials are now used.

The conventional side drum is usually hit on one ("upper") end only and the other end is induced to vibrate in response to aerial vibrations established when the upper head is struck. Snares consisting of wires or strings may be stretched diametrally across one or both skins to produce a rattling effect.

It is known to encase the marginal edge portions of the respective skins in "flesh hoops" surrounding the respective end portions of a cylindrical shell which constitutes the lateral wall of a side drum. It is also known to longitudinally secure steel tension blocks or bars longitudinally to the outside of the lateral wall, said bars adapted to receive the lower end portion of an elongated tension bolt. The other end of the bolt passes through an aperture in a right-angled clip and has a bolt-head fixed thereto. The under face of the bolt bears against the upper face of the relevant clip portion. The lower face of the clip bears against a shoulder portion of an outer hoop which, in turn, bears against the upper part of the flesh hoop. A dome nut is fixed to the remote lower end of the bolt and bears upwardly against the lower end of the tension bar.

Turning the bolt in one direction tends to force the relevant flesh hoop in towards the medial plane of the drum, and this tends to pull the skin radially outwards over the relevant end portion of the lateral wall, thereby tensioning the skin.

Turning the bolt in the opposite direction tends to relax the skin.

It has been found that such a gripping and tensioning arrangement tends to distort the shell structure e.g. by causing the tension bars to bow outwardly under the longitudinal forces at each end. This can lead to "tuning" instability and is generally incompatible with the physical characteristics of the fibrous skin materials now in general use.

An object of the invention is to provide an improved and more versatile drum tensioning structure wherein such problems are removed or substantially alleviated.

With this object in view the invention provides a drum head including a cylindrical side wall the end rim of which a skin is stretched thereover, said skin having a peripheral beading or flesh hoop, a plurality of adjustable stretching means engaging said peripheral beading or flesh hoop to exert tensioning forces on said skin, said forces acting in an imaginary cylindrical surface coaxial with and adjacent said side wall and substantially intersecting said peripheral beading or flesh hoop.

The tension is preferably communicated by means of a downwardly-elongated clip an upper part of which may be shaped, and may bear against the flesh hoop per medium of an outer hoop, as hereinbefore described.

A practical embodiment of the invention will now be described with reference to the non-limitative example illustrated in the accompanying drawings, in which:

FIG. 1 is a side perspective view of a drum including a drum head made according to the present invention; and FIG. 2 is a cross-sectional view along and in the direction of arrows 2—2 of FIG. 1.

In the drawings there is shown a drum 10 which includes a cylindrical shell 11 and drum heads 12 and 14 at each end thereof. The drum heads 12 and 14 include a cylindrical side wall 16 which slips over cylindrical shell 11. The drum heads are fixed to shell 11 by several fixing screws and nuts (not shown). An annular skirt 18 extends from side wall 16 and has apertures 20 for reception of tensioning bolts 22. A plurality of C-shaped clips 24 are threadably engaged by the lower arm 26 with bolts 22. The end face 28 of each clip 24 abuts the outer surface 30 of side wall 16.

The upper arm 32 of clip 24 has a hook 34 which cooperates with a complementary shaped shoulder 36 and axial extension 38 of a cylindrical hoop 40. The hoop 40 has offset arms 42 and 44 which form a further shoulder 46 at their interface. Under shoulder 46 is located a peripheral beading or flesh hoop 48 of a drum skin 50. The peripheral beading or flesh hoop 48 lies directly above (FIG. 2) the tensioning bolts 22 so that tensioning forces will act in an imaginary cylindrical surface coaxial with and adjacent side wall 16 and substantially intersecting the peripheral beading or flesh hoop 48.

As many tensioning bolt/clip combinations as are considered necessary can be provided around the drum head.

It has been found that our improved drum head is, in general, capable of more readily coming to grips with the relatively large forces that fibrous and other modern skin materials can make possible and desirable. Our invention also makes possible a more efficient, equable and/or advantageous distribution of such forces throughout the shell 11 than has generally been possible hitherto.

Furthermore the invention enables the relevant forces to be supported in and by a relatively short (e.g. steel and/or aluminium) length of the drum. Thus it is possible to eliminate tension bars or blocks and to confine the shell 11 to an (axially) short length of the drum, and the side wall itself may be of plastics or any other suitable material. Thus, if as shown there are 12, 14 drum heads at both ends the intermediate section or shell 11 can simply act as a "spacer" and can be made of suitable plastics material. This tends to lighten the drum as a whole. If desired, the plastics may be transparent so as to render visible any internal mechanism such as snare-adjusting contrivances 52 and the like.

It is merely for convenience that the invention has been described herein by reference to a drum with its axis vertical and the striking head uppermost. Therefore terms such as "upper", "lower", "lateral", "under", "bottom" and "below" are not to be read as necessarily limiting.

It is believed that the invention and many of its attendant advantages will be understood from the foregoing description and it will be apparent that various changes may be made in the form, construction and arrangement of the parts and that changes may be made in the form, construction and arrangement of the drum head described without departing from the spirit and scope of the invention or sacrificing all of its material advantages, the form hereinbefore described being merely a preferred embodiment thereof.

The claims defining the invention are as follows; I claim:

1. A drum head including a cylindrical side wall the end rim of which a skin is stretched thereover, said skin having a peripheral beading or flesh hoop spaced radially outwardly from said side wall, a cylindrical hoop co-axially mounted with respect to said cylindrical side wall and surrounding a part of said cylindrical side wall, said cylindrical hoop having a first inner downwardly disposed shoulder spaced radially outwardly from said side wall and which engages said periheral beading or flesh hoop and a second outer upwardly disposed shoulder slanting upwardly and outwardly above said first shoulder, an upward extension outwardly of said second shoulder, said cylindrical hoop having an outer cylindrical surface of substantial axial dimension extending downwardly from said upward extension, a plurality of adjustable stretching means for exerting tensioning forces on said skin, each of said stretching means including a clip and a tensioning bolt, each of said tensioning bolts projecting through an aperture in an outwardly protruding skirt portion of said cylindrical side wall and substantially aligned with said flesh hoop, each of said clips being C-shaped with an upper arm part having a downwardly and inwardly disposed hook for engagement over said upward extension and on said second shoulder of said cylindrical hoop and to be lockingly engaged with said cylindrical hoop and a lower arm part abutting said cylindrical side wall, a vertically straight inner surface between said arms engaging said outer cylindrical surface, said tensioning forces acting in an imaginary cylindrical surface coaxial with and adjacent said cylindrical side wall and substantially intersecting said peripheral beading or flesh hoop and said tensioning bolts, each said tensioning bolt threadably engaging with its respective clip.

2. A drum including a cylindrical shell and at least one end of which includes a drum head as claimed in claim 1, said cylindrical side wall being adapted to slide over said cylindrical shell and be affixed thereto.

* * * * *